US011067293B1

(12) United States Patent
Feiertag

(10) Patent No.: US 11,067,293 B1
(45) Date of Patent: Jul. 20, 2021

(54) SMOKE DIRECTOR DEVICE CONFIGURED TO EXTEND OVER A COOKING SURFACE OF A COOKING DEVICE

(71) Applicant: Alan Feiertag, Delray Beach, FL (US)

(72) Inventor: Alan Feiertag, Delray Beach, FL (US)

( * ) Notice: Subject to any disclaimer, the term of this patent is extended or adjusted under 35 U.S.C. 154(b) by 303 days.

(21) Appl. No.: 16/379,274

(22) Filed: Apr. 9, 2019

(51) Int. Cl.
*F24C 15/20* (2006.01)
*F24B 1/195* (2006.01)
*B08B 15/02* (2006.01)

(52) U.S. Cl.
CPC ..... *F24C 15/2092* (2013.01); *F24B 1/1955* (2013.01); *F24C 15/2071* (2013.01); *B08B 15/02* (2013.01)

(58) Field of Classification Search
CPC ..... F24C 15/2092; F24C 15/2071; F24C 15/2028; F24C 15/2078; F24C 15/28; F24C 15/20; F24B 1/1955; F24B 1/195; B08B 15/02
USPC ..... 126/299 F, 299 R; 454/63, 64, 65, 67
See application file for complete search history.

(56) References Cited

U.S. PATENT DOCUMENTS 607,976 A * 7/1898 Amos ..... F24C 15/2042 126/299 R
3,011,492 A * 12/1961 Humbert ..... F24C 15/2042 126/299 R
3,356,008 A * 12/1967 Simpson ..... F24C 15/2042 126/299 D
3,496,704 A * 2/1970 Bandlow ..... F24C 15/2092 96/138
4,934,337 A * 6/1990 Falk ..... F24C 15/2042 126/299 R
4,945,891 A * 8/1990 Cecil ..... F24C 15/2042 126/299 D
6,622,717 B1 * 9/2003 Kim ..... F24C 15/2042 126/299 D
6,647,978 B1 * 11/2003 Khosropour ..... F24C 15/2085 126/299 D
6,686,576 B1 * 2/2004 Yang ..... F24C 15/2092 126/299 D (Continued)

FOREIGN PATENT DOCUMENTS

DE 3822510 A1 * 1/1990 ..... F24C 15/2092
DE 3822511 A1 * 1/1990 ..... F24C 15/2092

(Continued)

*Primary Examiner* — Steven B McAllister
*Assistant Examiner* — Daniel E. Namay
(74) *Attorney, Agent, or Firm* — John Rizvi; John Rizvi, P.A.—The Patent Professor®

(57) ABSTRACT

A smoke director device for a cooking device includes a housing containing an extendable and retractable smoke director assembly and a mounting assembly for removably attaching the smoke director device to the underside of an over the stove exhaust system such as those included in microwave ovens. The housing includes a front opening through which the smoke director assembly extends and retracts, a rear opening to guide smoke and other particulates towards the exhaust system and a bottom opening to further capture any rising smoke and particulates. The smoke director assembly can include a fixed inner panel located in the housing, a movable end panel and a movable intermediate panel. The smoke director assembly can be tiltable relative to the housing, to angle the smoke director assembly relative to a cook surface of the stove.

19 Claims, 6 Drawing Sheets

(56) References Cited

U.S. PATENT DOCUMENTS

| | | | | |
|---|---|---|---|---|
| 6,715,484 | B2 * | 4/2004 | Khosropour | F24C 15/2035 126/299 D |
| 6,877,506 | B2 * | 4/2005 | Shekarri | F24C 15/2021 108/106 |
| 8,286,626 | B2 * | 10/2012 | Grobleben | F24C 15/2092 126/299 R |
| 8,915,983 | B2 * | 12/2014 | Broβmann | F24C 15/2035 55/385.1 |
| 9,307,582 | B2 * | 4/2016 | Yu | F24C 15/2092 |
| 9,713,204 | B2 * | 7/2017 | Kim | H05B 6/6423 |
| 9,989,261 | B2 * | 6/2018 | Jeong | F24C 15/2078 |
| 10,088,171 | B2 * | 10/2018 | Lee | F24C 15/2042 |
| 2003/0226558 | A1 * | 12/2003 | Khosropour | F24C 15/2042 126/299 R |
| 2003/0226559 | A1 * | 12/2003 | Khosropour | F24C 15/2028 126/299 R |
| 2003/0226560 | A1 * | 12/2003 | Shekarri | F24C 15/2021 126/299 R |
| 2004/0004077 | A1 * | 1/2004 | Jeong | H05B 6/6423 219/757 |
| 2004/0016754 | A1 * | 1/2004 | Yang | H05B 6/6423 219/757 |
| 2008/0083402 | A1 * | 4/2008 | Neumann | F24C 15/2064 126/299 D |
| 2010/0200576 | A1 * | 8/2010 | Song | H05B 6/6423 219/756 |
| 2013/0134156 | A1 * | 5/2013 | Yu | H05B 6/6408 219/757 |
| 2013/0240509 | A1 * | 9/2013 | Kim | H05B 6/6423 219/757 |
| 2015/0083106 | A1 * | 3/2015 | Jeong | F24C 15/2078 126/21 A |
| 2016/0169535 | A1 * | 6/2016 | Lee | F24C 15/2042 126/299 F |
| 2020/0278119 | A1 * | 9/2020 | Kenny | F24C 15/2092 |

FOREIGN PATENT DOCUMENTS

| | | | | | |
|---|---|---|---|---|---|
| EP | 1384952 | A2 * | 1/2004 | | F24C 15/2092 |
| JP | 57026333 | A * | 2/1982 | | |
| JP | 60164146 | A * | 8/1985 | | F24C 15/2092 |
| JP | 61091435 | A * | 7/1986 | | F24C 15/2092 |
| JP | 01270811 | A * | 10/1989 | | |
| JP | 03017458 | A * | 1/1991 | | |
| JP | 03274343 | A * | 12/1991 | | |
| JP | 2006317126 | A * | 11/2006 | | F24C 15/2092 |
| JP | 2008170034 | A * | 7/2008 | | F24C 15/2092 |
| JP | 2008185291 | A * | 8/2008 | | F24C 15/2092 |
| KR | 100624676 | B1 * | 9/2006 | | F24C 15/2092 |
| KR | 101509767 | B1 * | 4/2015 | | F24C 15/2021 |
| WO | WO-2006074837 | A1 * | 7/2006 | | F24C 15/2092 |
| WO | WO-2006074838 | A1 * | 7/2006 | | F24C 15/2092 |
| WO | WO-2006075028 | A1 * | 7/2006 | | F24C 15/2092 |

* cited by examiner

SMOKE DIRECTOR DEVICE CONFIGURED TO EXTEND OVER A COOKING SURFACE OF A COOKING DEVICE

FIELD OF THE INVENTION

The present invention relates generally to smoke directing devices for use with over-a-stove top exhaust systems, and more particularly, to a removable and extendable smoke director device to direct smoke and other particulates towards an over-the-stove exhaust system.

BACKGROUND OF THE INVENTION

It is important when cooking indoors to be careful not to allow smoke and other particulates rising off of a cooking surface and out of the foods being cooked to contaminate surrounding surfaces and adjacent rooms for health purposes and cleanliness. Indoor air pollution resulting from these contaminants are especially problematic for people with respiratory health conditions. Specifically, when foods are being cooked in a cooking utensil on a heated stove top cooking surface, the oils or fats the food is being cooked in vaporize and rise up off of the cooking utensil and into the surrounding air as smoke and other airborne particulates. Additionally, some cooked food particles are also vaporized and rise up in the form of smoke and other particulates. This is particularly true when the food is over cooked to the point of burning. The rising smoke and particulates constitute a serious health hazard.

Additionally, the rising smoke and particulates permeate the cooking room and any adjacent rooms. When these particulates land on cabinets, walls, floors or other surfaces, the oils and grime contained in the smoke and particulates contaminate the surfaces. The contaminated area may be substantial and maintaining these surfaces clean can become a difficult and time-consuming job, and possibly an expensive problem.

Over-the-stove top hoods having exhaust systems have been developed to draw off the rising smoke and particulates. However, these known systems cannot be used where a microwave oven is mounted over the stove or incorporated into a stove and microwave unit. Instead, microwave ovens themselves are often provided with small exhaust or air recirculation systems; however, since over-the-stove microwave ovens generally extend over only a small portion of the cook surface they are incapable of capturing the majority of the rising smoke and other particulates coming off of the stove top. This allows the remaining or excess smoke and particulates to contaminate the surrounding surfaces and areas.

Accordingly, there is an established need for a solution to at least one of the aforementioned problems, and especially a solution which allows to capture rising smoke and other particulates from an entire cooking or stove surface area, to minimize the dispersion of said smoke and particles to other rooms which may be communicated with the cooking room.

SUMMARY OF THE INVENTION

The present invention is directed to a convenient and removable smoke and particulate directing device that is capable of being extended out over a cooking surface to catch and direct rising smoke and other particulates towards an exhaust system. The smoke director device includes one or more smoke director units, each smoke director unit comprising a housing containing an extendable, telescoping smoke director assembly. At least one mounting assembly is provided for removably attaching the one or more smoke director units to an underside of an over the stove exhaust system such as those provided in an underside of an over-the-stove microwave oven. The mounting assembly includes a hinge to angle the smoke director relative to the cook surface of the stove.

In a first implementation of the invention, a smoke director device for use with a stove top exhaust system comprises one or more smoke director units. Each smoke director unit includes a hollow housing having an open front wall and an open back wall, and a reversibly retractable and extendable smoke director assembly movably mounted within the hollow housing. The retractable and extendable smoke director assembly is configured to adopt a retracted configuration in which the smoke director assembly is retracted within the hollow housing and an extended configuration in which the smoke director assembly extends frontward of the open front wall of the hollow housing. At least one mounting assembly is connected to the one or more smoke director units for attaching the one or more smoke director units to an underside of an exhaust containing structure arranged over a cooking surface of a stove.

In a second aspect, the smoke director assembly can include a fixed inner panel and a movable end panel. The movable end panel is movable relative to the fixed inner panel between a retracted condition contained within the hollow housing when the smoke director assembly is in the retracted configuration and an extended condition extending outward and frontward of the open front wall of the hollow housing and frontward of the fixed inner panel when the smoke director assembly is in the extended configuration.

In another aspect, the smoke director assembly can further include a movable intermediate panel located between the movable end panel and the fixed inner panel. The movable intermediate panel is movable relative to the movable end panel and fixed inner panel and is arranged frontward of the fixed inner panel and rearward of the movable end panel when the smoke director assembly is in the extended configuration.

In another aspect, at least one of the movable end panel, the movable intermediate panel and the fixed inner panel can be corrugated.

In another aspect, the movable end panel, the movable intermediate panel and the fixed inner panel can be corrugated. In some embodiments, the movable end panel, movable intermediate panel and fixed inner panel can include respective channels configured to align with one another to form effective front-to-back longitudinal channels extending from a front end of the smoke director assembly to a rear end of the smoke director assembly.

In yet another aspect, the smoke director assembly can further include an end support structure attached to and supporting the movable end panel and an intermediate support structure attached to and supporting the movable intermediate panel. The end support structure is movably connected to the intermediate support structure and the intermediate support structure is movably connected to the housing.

In another aspect, at least one stop can limit a movement of the end support structure relative to the intermediate support structure.

In another aspect, the smoke director assembly can further include a face plate connected to the movable end panel such that the face plate lies flush with the open front wall of the housing when the smoke director assembly is in the retracted configuration.

In another aspect, the smoke director assembly can further include a handle mounted to the face plate for manual pulling of the face plate.

In yet another aspect, the hollow housing can further include an open bottom wall.

In another aspect, the at least one mounting assembly can be removable from the one or more smoke director units.

In another aspect, the at least one mounting assembly can include a forward plate removably attachable to the hollow housing.

In another aspect, the mounting assembly can include a rear plate and a hinge positioned between the rear plate and the forward plate for angling the smoke director assembly relative to the cooking surface.

In yet another aspect, the mounting assembly can include a mounting magnet for detachably attaching the mounting assembly to the exhaust containing structure.

In another aspect, the mounting magnet can be located on the rear plate of the mounting assembly.

In another aspect, the one or more smoke director units can include two smoke director units attachable to one another in a side-by-side arrangement.

In another aspect, the two smoke director units can be magnetically attachable to one another.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a convenient and economical, removable and extendable smoke director device for use with a kitchen stove having a microwave oven or other smoke-exhausting device positioned over the stove and that is capable of being extended out over a stove top surface to safely direct any rising smoke or particulates into an exhaust or air recirculation system and fan of the microwave oven or other smoke-exhausting device.

Shown throughout FIGS. 1-8 is a smoke director device 100 in accordance with an illustrative embodiment of the invention, configured as a manually operable, extendable smoke director. The smoke director device 100 of the present embodiment comprises two smoke director units 102 attachable to one another and extendable over a cooking surface, as will be described in greater detail hereinafter. Alternative embodiments of the invention are contemplated, however, in which the smoke director device may include a single smoke director unit or more than two smoke director units.

Figure 1:
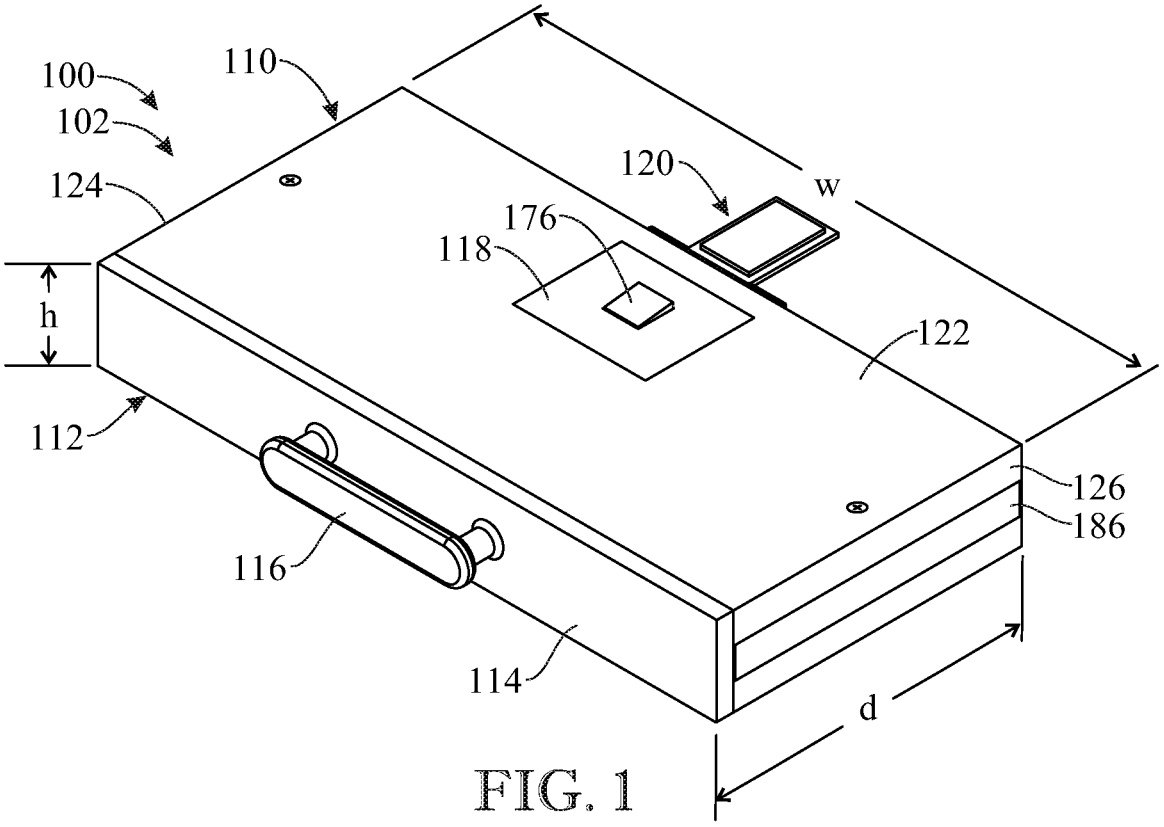
FIG. 1 presents a top front isometric view of a smoke director unit comprised in a smoke director device in accordance with an illustrative embodiment of the present invention.

Referring initially to FIG. 1, the smoke director unit 102 generally includes a hollow housing 110 retaining an extendable and retractable director assembly 112 for use in directing rising smoke and particulates into an exhaust mechanism as described hereinbelow. The director assembly 112 includes a face plate 114 and a handle 116 affixed to the face plate to draw out or extend the director assembly 112 from within the housing 110 for use in directing smoke and return or retract the director assembly 112 into the housing 110 when not needed or in use.

The housing 112 includes an optionally recessed, attachment area 118 for receipt of a removable mounting assembly 120. The removable mounting assembly 120 is provided to removably attach the smoke director unit 102 to an underside of a microwave oven or other over-a-stove exhausting device including a smoke exhaust system, as well as to allow the smoke director unit 102 and, in particular, the director assembly 112 to be angled out over a cooking surface to better catch and direct any rising smoke and particulates into the exhaust system of the microwave oven or other exhausting device.

In this particular embodiment, the smoke director unit 102 can have a width "w" of 15", a depth "d" of 6.75" and a height "h" of 1.75", for instance and without limitation. When two smoke director units 102 are combined in side by side relationship as discussed in more detail hereinbelow, they have a combined width "w" of approximately 30". In different embodiments of the invention, the smoke director unit 102 can be produced in varying sizes to accommodate differing stove top applications.

Figure 2:
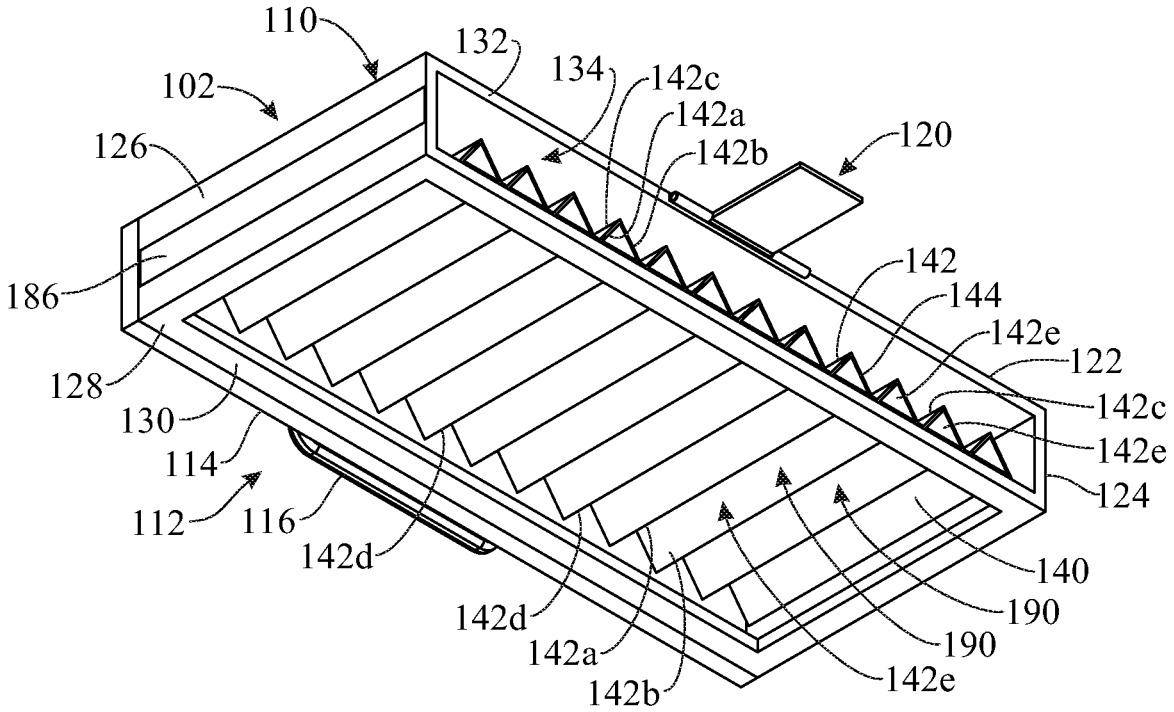
FIG. 2 presents a bottom rear isometric view of the smoke director unit of FIG. 1.
Figure 3:
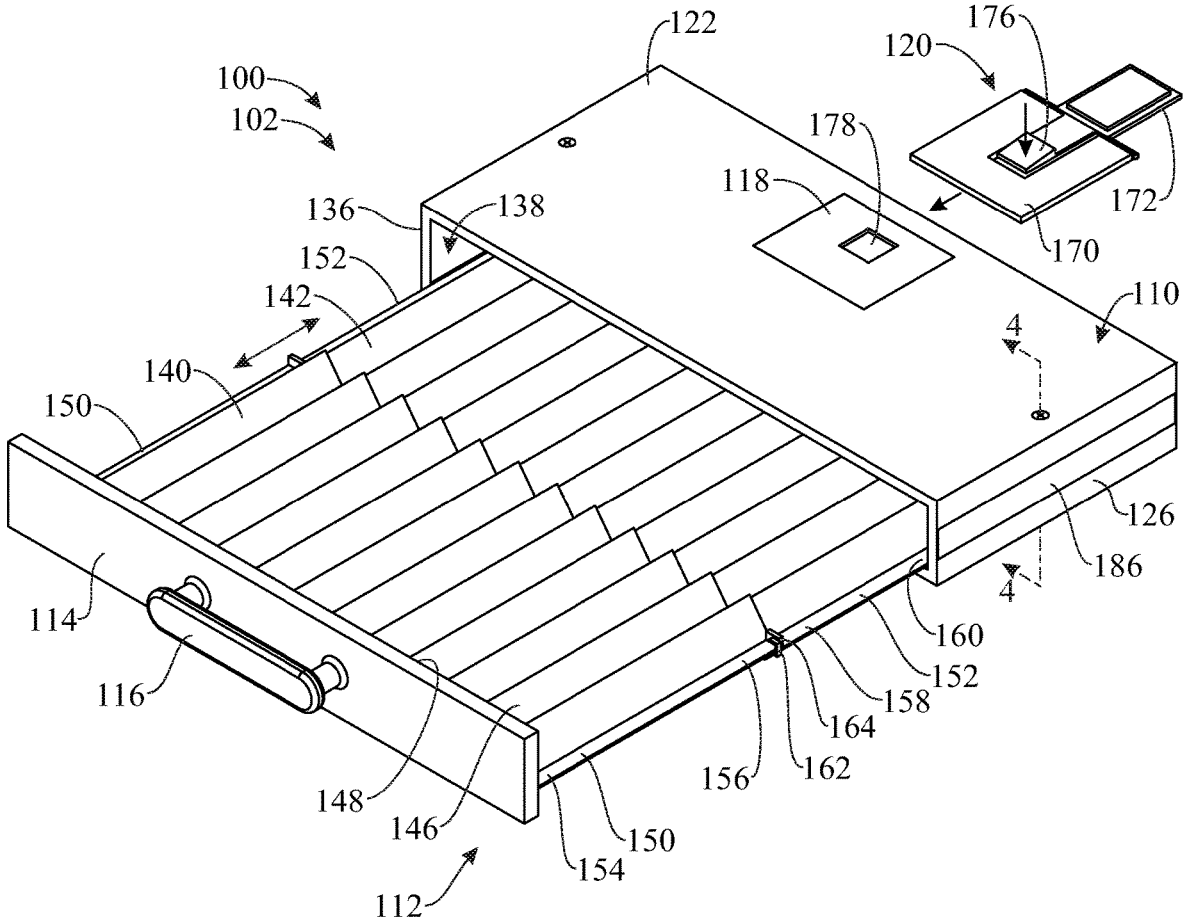
FIG. 3 presents a top front isometric view of the smoke director unit of FIG. 1, with movable smoke directing panels of the smoke director unit in an extended condition and illustrating a mounting system for the smoke director unit shown in a detached condition.

Referring now to FIGS. 2 and 3, the housing 112 includes a solid top wall 122, a solid first side wall 124 and a solid second side wall 126 arranged oppositely to the solid first side wall 124. The solid top, first side wall and second side wall 122, 124 and 126, respectively, function to contain any rising smoke and particulates captured by the smoke director assembly 112. In order to convey the smoke and particulates captured by the smoke director assembly 112 into an exhaust system of a microwave oven or other overhead exhausting device or structure (hereinafter referred to generally as microwave oven), the housing 112 includes an open bottom wall 128 defining a bottom wall opening 130 and an open rear wall 132 defining a rear wall opening 134. Smoke and particulates rising from a stove top are guided along the smoke director assembly 112 into the housing 110 and out the rear wall opening 134 to the exhaust system of the microwave oven, as will be described in greater detail hereinafter. The bottom wall opening 130 also receives rising smoke and particulates into the housing 112 such that they pass along the director assembly 112 and again out the rear wall opening 130. The bottom wall opening 130 channels the rising smoke and particulates regardless of whether the director assembly 112 is in the extended or retracted conditions.

As shown in FIG. 3, the housing 110 further includes an open front wall 136 defining a front wall opening 138. The director assembly 112 is extendable out of and retractable into the front wall opening 138 of the housing 110. In the retracted condition, shown in FIGS. 1 and 2, the face plate 114 of the director assembly 112 lies flush against the front wall 136. This prevents rising smoke and particulates from escaping out the front wall opening 138 when the director assembly 112 is in the retracted condition.

The disclosed smoke director 100 is provided to be attached to a microwave oven. Alternatively, the disclosed smoke director 100 can be attached directly to an upper component of a stove, such as, for example, an extended hood, and overhanging light assembly etc. to channel smoke and particulates into a standalone exhaust system or exhaust system directly associated with the stove itself.

With continued reference to FIG. 3, the director assembly 112 includes a first or movable end panel 140 affixed to the face plate 114 and a second or fixed inner panel 142 affixed within the housing 110. The director assembly may further include one or more third or movable intermediate panels 144 connected to the fixed inner panel 142 and the movable end panel 140. The movable end panel 140, the fixed inner panel 142 and the intermediate panel 144 are provided to catch or block the rise of smoke and particulates off of the cooking surface of the stove and guide or channel them through the housing 110 of the smoke director unit 102 and into an exhaust system of the microwave oven.

As shown, the first or movable end panel 140, the second or fixed inner panel 142 and the third or intermediate panel 144 of the present embodiment are not flat but have a corrugated shape, such as but not limited to a saw-toothed shape, to better catch and channel the smoke and particulates through the housing 110 and out the rear wall opening 134. For example, with specific reference to the fixed inner panel 142 (FIG. 2), the fixed inner panel 142 includes alternating angled flats 142*a* and 142*b* which are connected together at top edges 142*c* and bottom edges 142*d*. The angled flats 142*a* and 142*b* together form longitudinal channels 142*e* which facilitate capture, and more importantly, channeling of rising smoke and particulates towards the rear wall opening 134 for passage to an over-the-stove top exhaust system as described in more detail hereinbelow. The corrugated or saw-toothed shape of the other panels, i.e., the end panel 140 and the intermediate panel 144, can be identically constructed with corresponding alternating flats, top edges and bottom edges to form channels for guiding the smoke and other particulates into the front wall opening 138 of the housing 110 and towards the fixed inner panel 142 and the rear wall opening 134 of the housing. Other cross-sectional shapes are also contemplated such as, for example, wave shaped, alternating rectangular, sinusoidal, etc.

The movable end panel 140 and the intermediate movable panel 144 can be connected to the fixed inner panel 142 such that they are extendable and retractable relative to the fixed inner panel 142 and the housing 112 in telescoping fashion. The movable end panel 140 can be located under the fixed inner panel 142 with the intermediate panel 144 nested between the movable end panel 140 and the fixed inner panel 142. As shown in FIG. 3, a front end 146 of the movable end panel 140 is affixed to a rear surface 148 of the face plate 114 such that pulling the face plate 114 away from the housing draws the movable end panel 140 and the movable intermediate panel 144 out of the housing 110.

With further reference to FIG. 3, in order to support the movable end panel 140 and the movable intermediate panel 144 in the extended condition, the director assembly 112 can include extendable end and intermediate support structures 150 and 152, respectively. Specifically, the movable end panel 140 is supported within the end support structure 150 and the intermediate panel 144 is supported within the intermediate support structure 152. In some embodiments, the end support structure 150 can be slidably mounted within the intermediate support structure 152 in rail type fashion and the intermediate support structure 152 can be slidably mounted within the housing 112 also in rail type fashion.

A front end 154 of the end support structure 150 is affixed to the rear surface 148 of the face plate 114 and a rear end 156 of the end support structure 150 is movable within the intermediate support structure 152. The intermediate support structure 152 includes a front end 158 and a rear end 160. Stops 162 and 164 are provided on the rear end 156 of the movable end support structure 150 and the front end 158 of the intermediate support structure 152, respectively, to prevent the end support structure 150 and the intermediate support structure 152 from pulling apart. While not specifically shown, similar stops are provided on the rear end 160 of the intermediate support structure 152 and a rail system on the inside of the first and second side walls 124 and 126 of the housing 110 to prevent the intermediate support structure 152 from pulling apart from the housing 110 when extended.

The components of the smoke director 100 may be formed from a variety of materials. For instance, the housing 110 may be formed from metallic material such as, but not limited to, stainless steel, powder coated or painted steel color coordinated to surrounding appliance colors, etc. or may be formed from polymeric materials. Preferably, the housing 110 is formed from stainless steel which is easily cleanable of grease and grime. The face plate 114 can be formed from a similar material to that used in the housing 110 for a uniform appearance. The handle 116 can be formed from a variety of materials including woods, ceramics, polymeric materials or metallic materials to match the housing 110. The support structures, including the end support structure 150 and the intermediate support structure 152 are preferably formed from a metallic material for strength. The smoke directing panels including the movable end panel 140, the fixed inner panel 142 and the movable intermediate panel 144 may also be formed from a variety of heat resistant materials and preferably from corrugated stainless steel. Additionally, the smoke directing panels may be coated so as to better allow any smoke or particulates to flow along surfaces thereof.

Figure 4:
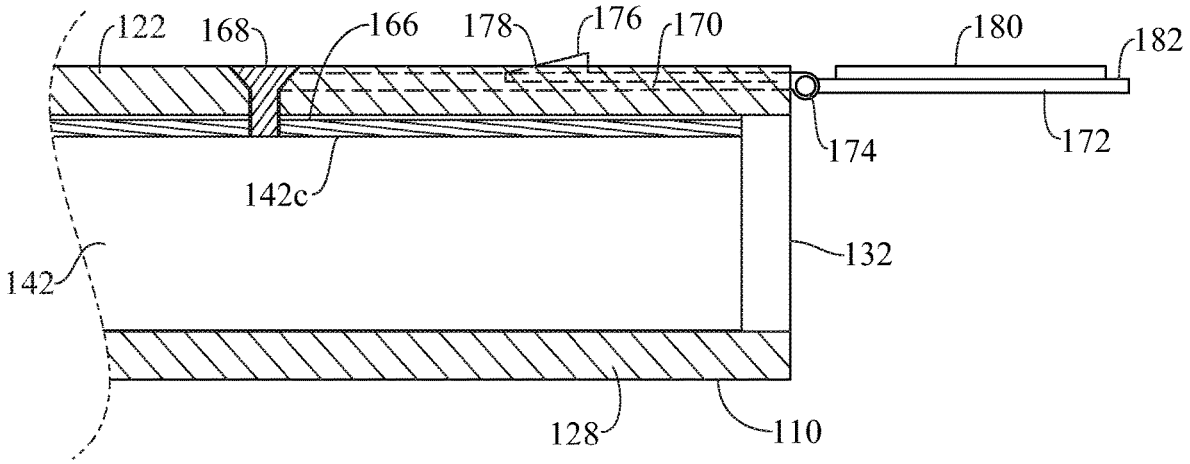
FIG. 4 presents a partial cross-sectional, side elevation view of a rear portion of the smoke director unit of FIG. 1, illustrating attachment of a fixed smoke directing panel within a housing of the smoke director unit and with the mounting system in an attached condition.

Referring to FIGS. 3 and 4, and initially to FIG. 4, it can be seen that a rear end 166 of the fixed inner panel 142 is fixedly attached to the housing 110 by screws 168. Specifically, as shown, the screws 168 are affixed to the top edges 142*c* of the fixed inner panel 142. With continued reference to FIGS. 3 and 4, and as noted above, the removable mounting assembly 120 is provided to attach the housing 110 to a microwave oven and allow the housing 110, and thus the extendable director assembly 112, to be angled relative to a cooking surface located beneath the smoke director 100. The mounting assembly 120 includes a forward plate 170, a rear plate 172 and a hinge 174 pivotally connecting the forward plate 170 to the rear plate 172. The hinge 174 has sufficient internal friction that it maintains the housing 110 and the smoke director assembly 112 at any particular angle set as discussed below.

With continued reference to FIGS. 3 and 4, the forward plate 170 is removably attachable to the housing 110 and includes a flexible tab 176 which removably engages a cutout 178 formed in the attachment area 118 on the top wall 122 of the housing 110. In order to removably mount the smoke director unit 102 to an underside of a microwave oven, the rear plate 172 is provided with a strong magnet 180 on an upper surface 182 of the rear plate 172. This allows the entire smoke director unit 102 to be easily attached to the microwave and easily removed for cleaning.

The smoke director unit 102 may be combined with additional smoke director units to increase the surface area covered by the smoke director assemblies 112. In order to facilitate keeping the units in a side by side relationship, a magnetic strip 186 is provided on the housing 110. Specifically, in this embodiment, the magnetic strip 186 is provided on the second side wall 126 of the housing 110.

Figure 5:
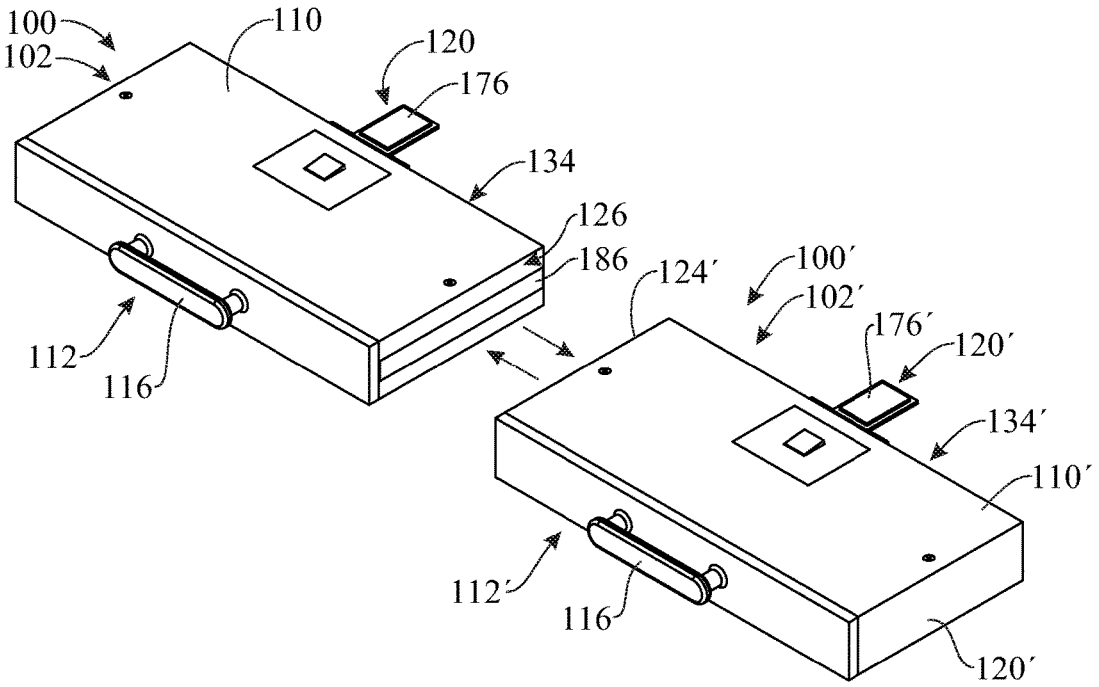
FIG. 5 presents a top front isometric view of two smoke director units in accordance with FIG. 1 prior to being connected to one another, to form a dual-unit smoke director device.

Turning for the moment to FIG. 5, it can be seen that the smoke director unit 102 may optionally be combined with a second smoke director unit 102' to form a dual-unit smoke director system 100 and increase the covered surface area. The magnetic strip 186 on the second side wall 126 of the housing 110 magnetically connects the second side wall 126 to a first side wall 124' of the second smoke director unit 102'. This maintains the first and second smoke director units 102 and 102', respectively, in side by side relationship to prevent any rising gasses or particulates from passing therebetween. It should be noted that the second smoke director unit 102' is substantially identical to the first smoke director unit 102. The addition of a magnetic strip on the second side wall 126' would render the second smoke director unit 102' identical to the first smoke director unit 102.

Referring now to FIGS. 1-8, the use of the smoke director units 102 and 102' to capture smoke and particulates rising up from a cooking surface of a stove and direct them to an exhaust system of a microwave oven will now be described. Referring initially to FIGS. 3 and 4, the mounting assemblies 120 and 120' are affixed to the housings 110 and 110'. For example, the forward plate 170 of the mounting assembly 120 is inserted into the top wall 122 of the housing 110 until the flexible tab 176 of the mounting assembly 120 reaches and engages the cutout 178 formed in the recessed attachment area 118 in the top wall 122. This locks the mounting assembly 120 to the housing 110. The mounting assembly 120' is similarly affixed to the housing 110' of the second smoke director unit 102'.

Referring to FIG. 5, the two smoke director units 102 and 102' are connected together by placing them adjacent to each other and allowing the magnet strip 186 on the second side wall 126 of the housing 110 of the first smoke director unit 102 to attract and attach to the first side wall 124' of the housing 110' of the second smoke director unit 102'. Once the two units have been magnetically connected together, they are ready to be installed on a microwave oven. Alternatively, the first and second smoke director units 102 and 102' can be magnetically connected in side-by-side relationship after each has been individually connected to the microwave as described below. Initially, the smoke directing assemblies 112 and 112' of the first and second smoke director units 102 and 102' are in the retracted condition with the smoke directing assemblies 112 and 112' contained within the respective housings 110 and 110'.

Figure 6:
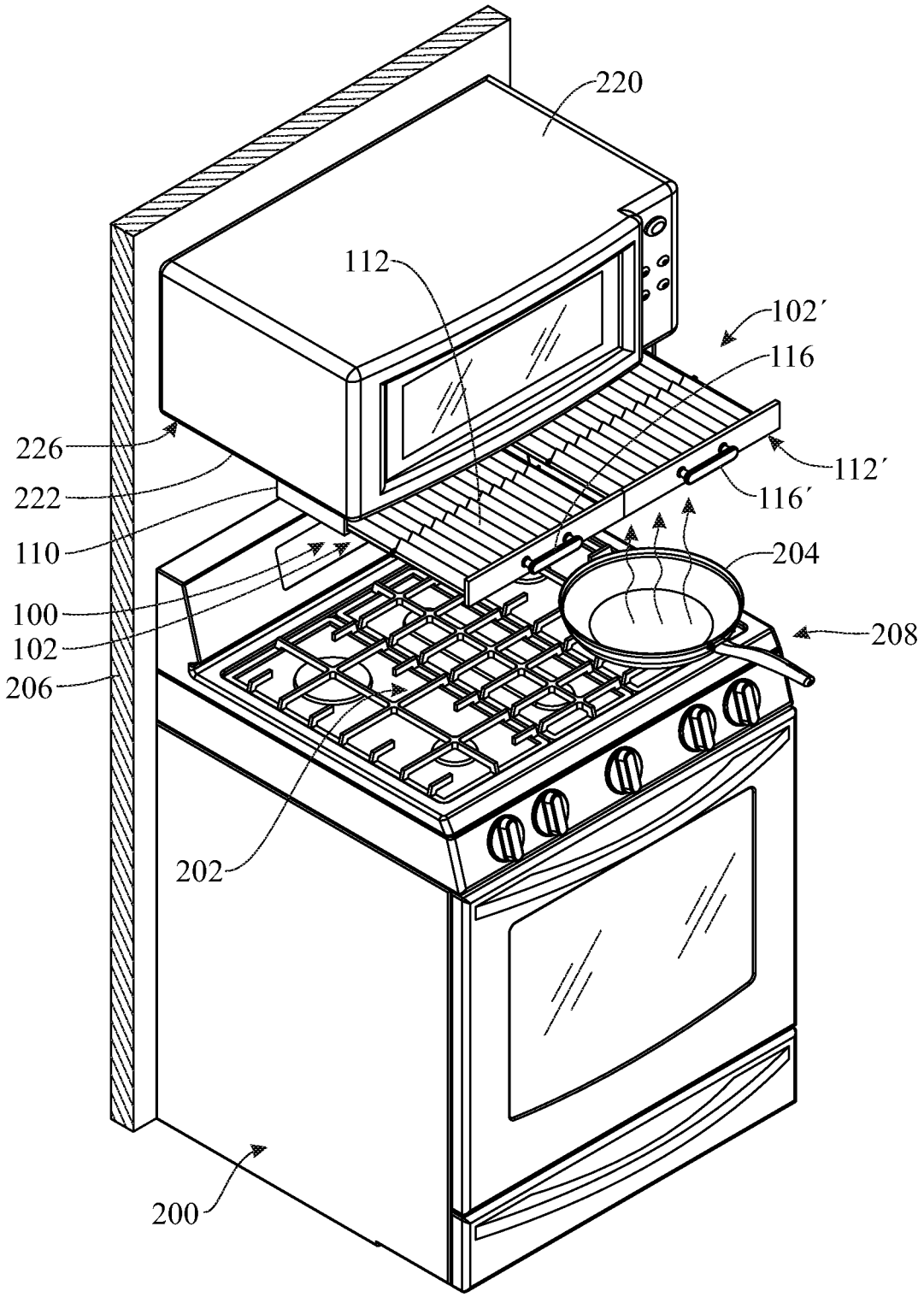
FIG. 6 presents a top front isometric view of the two smoke director units in accordance with FIG. 1, connected together and installed under a microwave oven and over a cooking surface of a stove and with the movable panels of the smoke director units in the extended condition.
Figure 7:
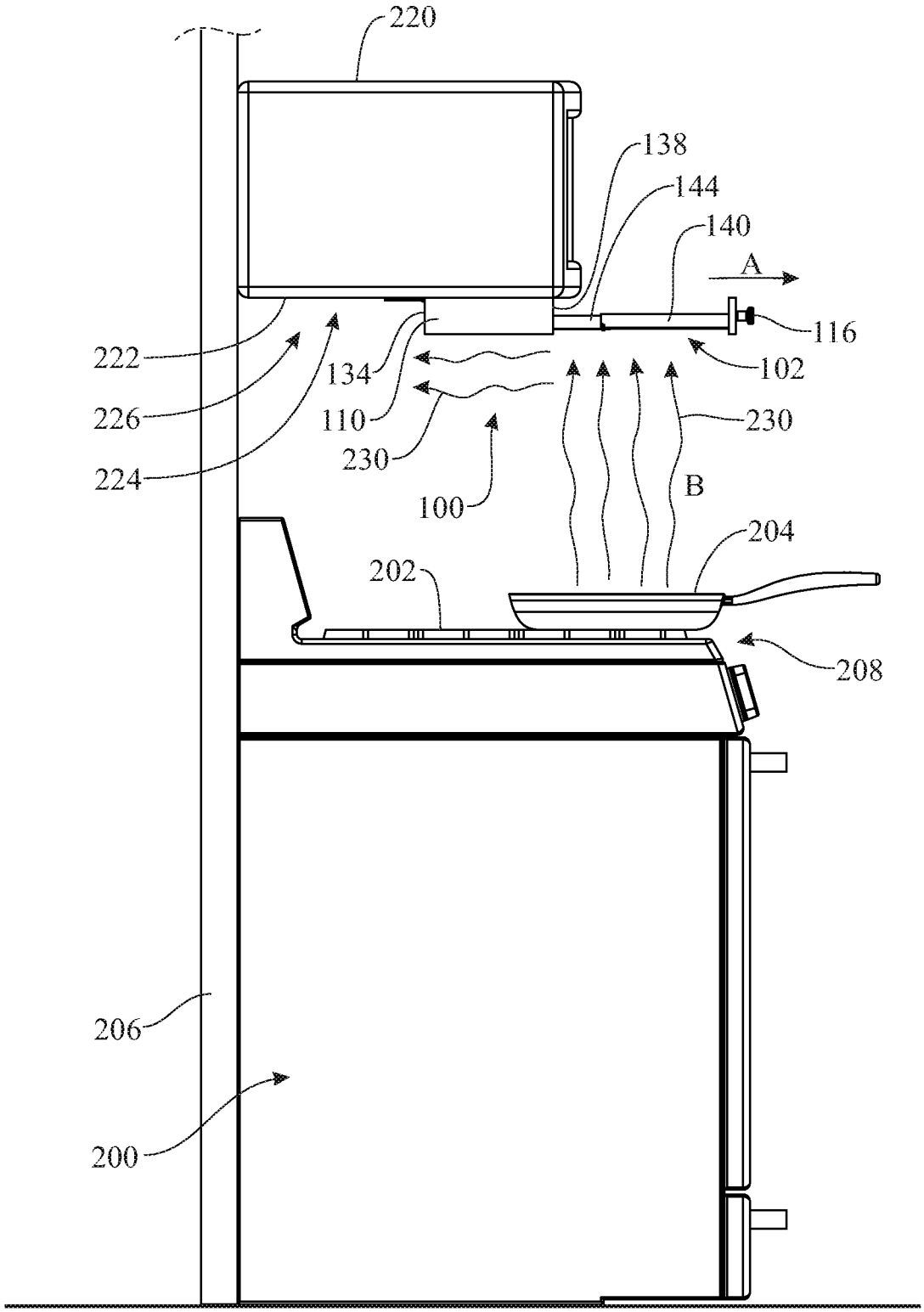
FIG. 7 presents a side elevation view of the smoke director device, mounted under the microwave oven and over the cooking surface and with the movable panels in the extended condition.
Figure 8:
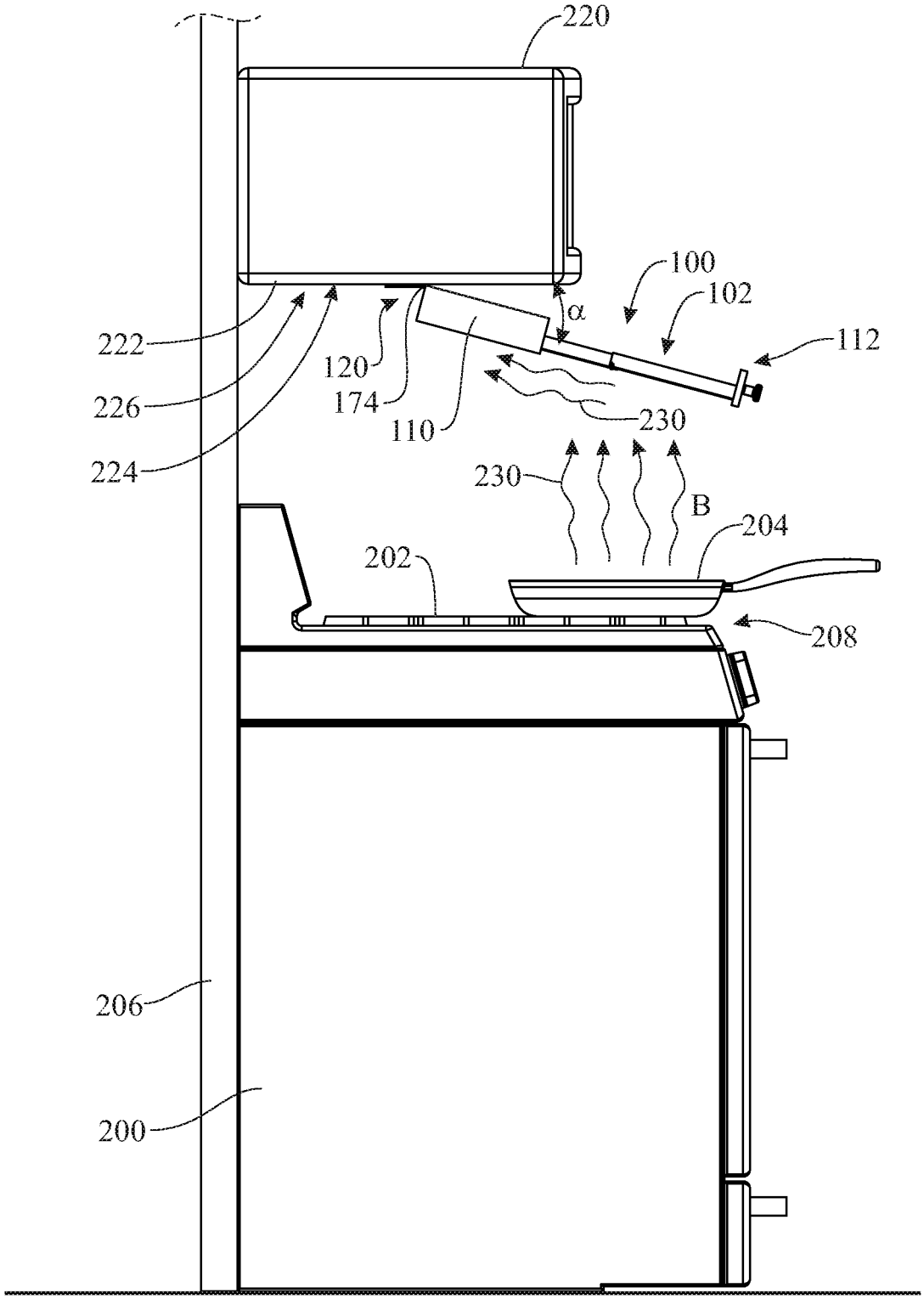
FIG. 8 presents a side elevation view, similar to FIG. 7, with the mounting system in a pivoted condition to angle the smoke director assemblies of the smoke director device relative to the cooking surface of the stove.

Turning now to FIGS. 6-8, the first and second smoke director units 102 and 102' are shown mounted over a stove 200 having a cooking surface 202 for receipt of cooking utensils 204. The stove 200 is placed adjacent to or against an upright wall or back 206 which in turn supports and maintains an exhaust system or, in this application, a microwave oven 220, above the cooking surface 202 of the stove 200. The first and second smoke director units 102 and 102' are affixed to an undersurface 222 of the microwave oven 220 by attaching the magnets 176 and 176' (FIG. 5) of the respective mounting assemblies 120, 120' of the first and second smoke director units 102 and 102' to the undersurface 222. The first and second smoke director units 102 and 102' are positioned on the undersurface 222 of the microwave oven 220 such that the rear wall openings 134 and 134' of the first and second smoke director units 102 and 102', respectively, are adjacent an exhaust system 224 at a rear 226 of the undersurface 222 of the microwave oven 220. This ensures that any smoke and particulates 230 directed or captured by the smoke director units 102 and 102' are directed and channeled towards and into the exhaust system 224 of the microwave oven 220. In the closed or retracted condition, the smoke director units 102 and 102' still capture any rising smoke and particulates 230 through the bottom wall opening 130, 130' where the smoke and particulates 230 encounter the fixed inner panels 142, 142' and are directed by the fixed inner panels 142, 142' out the rear wall openings 134, 134' towards the exhaust system 224 of the microwave oven 220.

As noted above, the initial mounting of the first and second smoke director units 102 and 102', respectively, is accomplished with the smoke director assemblies 112 and 112' in the closed or retracted condition within the respective housings 110 and 110'. Should the user be cooking near a front 208 of the stove 200 or generating a larger than normal amount of rising smoke and particulates 230, the smoke director assemblies 112 and 112' can be pulled out to the extended condition shown in FIG. 6 to cover a larger surface area of the cooking surface 202 and capture any rising smoke and particulates generated by the stove 200.

With specific reference to FIG. 7, the handle 116 is grasped and pulled in the direction of arrow "A" to extend the smoke director assembly 112 out over the cooking surface 202. This places the movable end panel 140 and the movable intermediate panel 144 out over the cooking surface 202. As can be seen, this provides a much larger surface area extending out over the cooking surface 202 to guide smoke and particles than is available from just the undersurface 222 of the microwave oven 220 alone. In fact, the entire cooking surface 202 can be covered, as shown, by pulling both handles 116 and 116' sufficiently outward. The user may also choose to pull a single smoke director assembly 112 or 112' outward by pulling the corresponding handle 116 or 116' and not pulling the remaining handle 116' or 116.

Once the smoke director assemblies 112 and 112' have been moved to the extended condition out of the respective housings 110 and 110', they are in a condition to capture and direct smoke and particulates to an exhaust system 224 located in the undersurface 222 of the microwave 220. When a cook (not shown) starts cooking food in the cooking utensil 204 on the cooking surface 202, the smoke and particulates 230 rise up in the direction of arrow "B". In the absence of the smoke director units 102 and 102', only a small portion of the smoke and particulates 230 would be captured by the exhaust system 224 of the microwave leaving a large amount of smoke and particulates to contaminate the room and surrounding areas. However, with the smoke director assemblies 112 and 112' in the extended condition out over the rising smoke and particulates 230, the smoke and particulates 230 hit the movable end panels 140, 140' and the movable intermediate panels 144, such that the smoke and particulates 230 are guided in the direction of arrow "B" along the panels and into the front wall opening 138 in the housing and along the fixed inner panel 142 and out the rear wall opening 134 (FIG. 2). Any smoke and particulates 230 that by pass the front wall opening 138 can rise up and enter the housing 110 through the bottom wall opening 130 where they are, again, directed by the fixed inner panel 142 toward the rear wall opening 134. The ability of the panels to capture and direct the smoke and particulates 230 toward the rear wall opening 134 is further enhanced by the corrugated or saw toothed shaped pattern of the panels which provides front-to-back, longitudinal channels 190 (FIG. 2) and a greater surface area than would be present with flat panels. As noted hereinabove, other panel shapes, such as, for example, wave shaped, would accomplish the same result.

Referring to FIG. 8, should the user desire to capture the rising smoke and particulates 230 closer to the smoke director assemblies 112 and/or 112', the smoke director assemblies 112 and/or 112' can be angled downwardly at an angle $\alpha$ relative to the cooking surface 202 of the stove by bending the mounting assemblies 120 and 120' about the hinges 174. Preferably, angle $\alpha$ is adjustable by the user. For instance, as noted above, the hinges 174 can have sufficient internal friction to maintain the smoke director assemblies 112, 112' in any set angle $\alpha$. In this embodiment the angle $\alpha$ is approximately between 0°-70°.

In this manner, the disclosed smoke director 100 provides an easily mountable smoke directing unit which is capable of being extended out over a cooking surface 202 to direct rising smoke and particulates 230 to an exhaust system to better capture a larger amount of the smoke and particulates 230.

In summary, an extendable smoke directing device is provided which can be installed beneath an over-a-stove microwave oven or other exhausting device having an over-the-stove exhaust system. The extendable smoke directing device can be extended out over the surface of the stove generating the smoke and particulates and direct or channel the rising smoke and particulates towards the exhaust or air recirculation system of the microwave oven or other exhausting device. The extendable smoke directing device can be quickly and easily removed from the stove area for cleaning.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A smoke director device for use with a stove top exhaust system, the smoke director device comprising:

one or more smoke director units, each smoke director unit comprising:

a hollow housing having an open front wall and an open back wall, and a reversibly retractable and extendable smoke director assembly movably mounted within said hollow housing and configured to adopt a retracted configuration in which the smoke director assembly is retracted within the hollow housing and an extended configuration in which the smoke director assembly extends frontward of the open front wall of the hollow housing; and at least one mounting assembly connected to said one or more smoke director units for attaching said one or more smoke director units to an underside of an exhaust containing i. structure arranged over a cooking surface of a stove;

wherein the smoke director assembly comprises a fixed inner panel and a movable end panel such that said movable end panel is movable relative to the fixed inner panel between a retracted condition contained within said hollow housing when the smoke director assembly is in the retracted configuration and an extended condition extending outward and frontward of said open front wall of said hollow housing and frontward of the fixed inner panel when the smoke director assembly is in the extended configuration.

2. The smoke director device of claim 1, wherein the smoke director assembly further comprises a movable intermediate panel located between the movable end panel and the fixed inner panel, wherein the movable intermediate panel is movable relative to the movable end panel and fixed inner panel and is arranged frontward of the fixed inner panel and rearward of the movable end panel when the smoke director assembly is in the extended configuration.

3. The smoke director device of claim 2, wherein at least one of the movable end panel, the movable intermediate panel and the fixed inner panel is corrugated.

4. The smoke director device of claim 2, wherein the movable end panel, the movable intermediate panel and the fixed inner panel are corrugated.

5. The smoke director device of claim 4, wherein the movable end panel, movable intermediate panel and fixed inner panel comprise respective channels configured to align with one another to form front-to-back longitudinal channels extending from a front end of the smoke director assembly to a rear end of the smoke director assembly.

6. The smoke director device of claim 2, wherein the smoke director assembly further comprises an end support structure attached to and supporting the movable end panel and an intermediate support structure attached to and supporting the movable intermediate panel, wherein the end support structure is movably connected to the intermediate support structure and the intermediate support structure is movably connected to the housing.

7. The smoke director device of claim 6, wherein at least one stop limits a movement of the end support structure relative to the intermediate support structure.

8. The smoke director device of claim 1, wherein the smoke director assembly further comprises a face plate connected to the movable end panel such that the face plate lies flush with the open front wall of the housing when the smoke director assembly is in the retracted configuration.

9. The smoke director device of claim 8, wherein the smoke director assembly further comprises a handle mounted to the face plate for manual pulling of the face plate.

10. The smoke director device of claim 1, wherein the hollow housing further comprises an open bottom wall.

11. The smoke director device of claim 1, wherein the at least one mounting assembly is removable from the one or more smoke director units.

12. The smoke director device of claim 1, wherein the at least one mounting assembly comprises a forward plate removably attachable to the hollow housing.

13. The smoke director device of claim 1, wherein the mounting assembly comprises a rear plate and a hinge positioned between the rear plate and the forward plate for angling the smoke director assembly relative to the cooking surface.

14. The smoke director device of claim 1, wherein the mounting assembly comprises a mounting magnet for detachably attaching the mounting assembly to the exhaust containing structure.

15. The smoke director device of claim 14, wherein the mounting assembly comprises a rear plate and a hinge positioned between the rear plate and the forward plate for angling the smoke director assembly relative to the cooking surface, and further wherein the mounting magnet is located on the rear plate of the mounting assembly.

16. The smoke director device of claim 1, wherein the one or more smoke director units comprise two smoke director units attachable to one another in a side-by-side arrangement.

17. The smoke director device of claim 16, wherein the two smoke director units are magnetically attachable to one another.

18. A smoke director device for use with a stove top exhaust system, the smoke director device comprising:

one or more smoke director units, each smoke director unit comprising:

a hollow housing having an open front wall and an open back wall, and a reversibly retractable and extendable smoke director assembly movably mounted within said hollow housing and comprising a fixed inner panel and a movable end panel movable relative to the fixed inner panel, wherein the smoke director assembly is configured to adopt a retracted configuration in which the smoke director assembly is retracted within the hollow housing and the movable end panel is arranged within the hollow housing, and an extended configuration in which the smoke director assembly extends frontward of the open front wall of the hollow housing and the movable end panel extends outward and frontward of said open front wall of said hollow housing and frontward of the fixed inner panel; and at least one mounting assembly connected to said one or more smoke director units for attaching said one or more smoke director units to an underside of an exhaust containing structure arranged over a cooking surface of a stove.

19. A smoke director device for use with a stove top exhaust system, the smoke director device comprising:

one or more smoke director units, each smoke director unit comprising:

a hollow housing having an open front wall and an open back wall, and a reversibly retractable and extendable smoke director assembly movably mounted within said hollow housing and comprising a fixed inner panel and a movable end panel movable relative to the fixed inner panel, wherein the smoke director assembly is configured to adopt a retracted configuration in which the smoke director assembly is retracted within the hollow housing and the movable end panel is arranged within the hollow housing, and an extended configuration in which the smoke director assembly extends frontward of the open front wall of the hollow housing and the movable end panel extends outward and frontward of said open front wall of said hollow housing and frontward of the fixed inner panel; and at least one mounting assembly connected to said one or more smoke director units for attaching said one or more smoke director units to an underside of an exhaust containing structure arranged over a cooking surface of a stove; wherein the smoke director assembly is tiltable relative to the housing.

* * * * *